US007258607B1

(12) United States Patent
Machiorlette et al.

(10) Patent No.: US 7,258,607 B1
(45) Date of Patent: Aug. 21, 2007

(54) RETURN AIR GRILLE ASSEMBLY

(76) Inventors: Steven C. Machiorlette, 2315 Maroneal St., Houston, TX (US) 77030; Jessie Figueroa, 3331 Kempwood Dr., Sugar Land, TX (US) 77479

( * ) Notice: Subject to any disclaimer, the term of this patent is extended or adjusted under 35 U.S.C. 154(b) by 167 days.

(21) Appl. No.: 11/029,760

(22) Filed: Jan. 5, 2005

Related U.S. Application Data

(60) Provisional application No. 60/552,630, filed on Mar. 12, 2004.

(51) Int. Cl.
*F24F 7/00* (2006.01)

(52) U.S. Cl. ..... 454/276; 454/309; 454/289

(58) Field of Classification Search ..... 454/289, 454/309, 275, 277, 290
See application file for complete search history.

(56) References Cited

U.S. PATENT DOCUMENTS

| | | | | |
|---|---|---|---|---|
| 345,692 | A | 7/1886 | Hayes | |
| 2,096,271 | A * | 10/1937 | Young | 454/309 |
| 2,847,730 | A | 8/1958 | Warwick | |
| 4,334,899 | A | 6/1982 | McConnell | |
| 5,163,871 | A | 11/1992 | Huibregtse et al. | |
| 5,226,293 | A | 7/1993 | Brock | |
| 5,255,486 | A | 10/1993 | Wang | |
| 5,639,069 | A | 6/1997 | McClure | |
| 5,863,310 | A * | 1/1999 | Brown et al. | 55/480 |
| 5,928,078 | A * | 7/1999 | Moore et al. | 454/330 |
| 6,012,260 | A | 1/2000 | Hendrick et al. | |
| 6,083,100 | A * | 7/2000 | Hardy et al. | 454/290 |
| 6,219,985 | B1 | 4/2001 | Hsu | |
| 6,234,893 | B1 * | 5/2001 | Meredith | 454/289 |
| 6,234,894 | B1 * | 5/2001 | Goracke et al. | 454/290 |
| 6,257,976 | B1 * | 7/2001 | Richardson, III | 454/309 |
| 6,270,401 | B1 * | 8/2001 | Wormmeester | 454/290 |
| 6,302,784 | B1 * | 10/2001 | Berger | 454/289 |
| 6,422,935 | B1 | 7/2002 | Yampolski | |
| 7,097,558 | B2 * | 8/2006 | Berger | 454/289 |

OTHER PUBLICATIONS

"Wood Return Air Grills—An Attractive Alternative to Metal Grills," Stephan Manufacturing, West Monroe, LA.

* cited by examiner

*Primary Examiner*—Derek S. Boles
(74) *Attorney, Agent, or Firm*—Locke Liddell & Sapp LLP

(57) ABSTRACT

The present disclosure provides an air grille assembly for use especially with air conditioning and heating ducts, having a detachable grille constructed of a relatively thick material, such as wood, synthetic wood, vinyl or the like. The grille can mount against the structure and be coupled to a housing of thinner material that can fit in a standard-sized opening, and leave enough room for a standard-sized filter commensurate with such opening. Further, the disclosure can also provide an air grille assembly having a detachable grille with an exposed exterior frame with no movable or visible hardware, and can be removed from a housing by lifting the grille frame straight up or over, angling out the bottom and then sliding in the opposite direction. The grille assembly can be coupled into a structure's opening, and can include flanges to help ensure proper mounting without the use of special tools.

7 Claims, 7 Drawing Sheets

RETURN AIR GRILLE ASSEMBLY

This application claims the benefit of U.S. Provisional Application No. 60/552,630, filed Mar. 12, 2004.

FIELD

The present invention relates to airflow through openings. More particularly, the present invention relates to airflow grills and associated housing.

BACKGROUND

Heating ventilation and air conditioning (HVAC) systems require both a supply duct system for output to the occupied space of a building structure and a return air duct system to re-circulate conditioned back to the HVAC system. Supply ducts have grilles that serve to diffuse the air going into the room and return air ducts have grilles that hide the view of the ducts or filters, as the case may be. To clean the circulated air, an HVAC system has filters in one of two locations in the return air portion accessible for periodic cleaning and replacement. The accessible locations are either immediately behind the return air grille or at the HVAC unit, which is typically in an attic or basement. When the filter is located just behind the grille, the grille assembly needs to provide easy access for filter removal and replacement. When the filter is located at the HVAC unit, the grille assembly needs to provide easy access for duct cleaning since dirty air is being returned through those ducts to the HVAC system.

Since return air grilles are most often prominently located and visible in the building, they do not commonly have visible screws or latches to hold them in place, unless they are "fixed" grilles which use visible screws to hold them in place. Even then, hiding the screw heads is preferable, if possible.

When a return air duct is located in a wall or ceiling and requires easy access behind the grille without visible screws, access is most commonly accomplished with a two-part assembly. One part is a framed housing designed to hold both the grille and a standard-sized filter and be screwed or nailed into a return air duct opening. The second part is either (i) a hinged grille attached to the framed housing or (ii) a removable grille with hardware that "catches" movable hardware (such as rotatable latches, pins, and screws), holes or "dimples" in the framed housing.

Currently, the most common return air grille assemblies are designed using only one material, both the framed housing and the hinged or removable grille. Materials most commonly used for such assemblies are metal, such as aluminum or steel, where the assemblies are generally manufactured by "stamping" relatively thin metal, often as thin as 0.030." Further, HVAC systems are typically designed with sizes contemplating the use of standard-sized return air openings, standard-sized removable air filters, and correspondingly sized steel or aluminum return air grilles. For example, one industry standard-sized opening has a nominal size of 20"×25". The actual opening in the structure is about ⅛" to ½" larger across the face of the opening, such as side to side, to allow the housing to fit therein. The filter size also has a nominal size also of 20"×25" with an actual size of about ¼" to about ½" less across the face of the filter to fit inside the relatively thin housing. The next smaller standard-sized opening for both dimensions is 18"×20" and the next larger standard-sized opening is 20"×30".

In less common instances, wood or wood-like material is used, which includes both (i) the visible grille and (ii) the framed housing that affixes at the return air opening. However, current wood grille designs pose installation problems and often require additional costs associated with modifying the opening or the grille's hardware for adequate installation.

The first problem occurs when installing a wood return air grille and its wood housing in an opening designed for a standard-sized metal grille assembly. Since the dimensions of a standard-sized opening accommodate a metal grille assembly that holds a commensurate standard-sized filter, such openings do not account for the additional thickness that a wood framed housing presents, assuming the same size filter is being used. Therefore, the standard-sized opening could only accommodate a smaller wood frame and commensurate smaller filter than the prior housing and filter, thereby restricting air flow in the return air system.

For those wishing to have a wood housing and grille with at least the same size filter, existing openings must be torn out and reframed (or new openings specially dimensioned) to a larger opening size to accommodate the thicker material of the framed housing.

Renovation requires modifying the opening of the sheetrock, wood paneling, or even brick or stone, as well as the framing behind it and, in most cases, is prohibitively expensive. This is one major reason wood return air grilles are rarely found in existing homes. Even with new construction, installation problems arise from the inexperience of contractors trained to work around industry standards and norms. Often, the opening is built incorrectly and requires on-sight modifications.

In the above example of the standard-sized opening with a nominal size of 20"×25", the extra thickness of the wood framed housing with the wood grille precludes the use of the same size filter. Thus, the structure opening would have to be torn out or a smaller standard-sized filter used, such as with an 18"×20" nominal size. Yet, the smaller size restricts air flow and can affect performance of the entire HVAC system.

Another wood grille commercially available attempts to solve the above size problem by completely eliminating the housing and simply installing the wood grille into the structure opening without the housing. However, problems persist with this design. First, this design can require that the opening be wider than one for a metal grille assembly, thus requiring modification of the opening. An additional problem results from this design's reliance on movable clasps that can be unreliable at holding the grille in the structure opening in the event the grille is inadvertently pulled, knocked, or requires a ceiling installation.

The second problem with some existing wood air grille assemblies is that the housing frame may not easily install flush with the wall or ceiling, in contrast to the standard metal grille assembly. A standard metal grille assembly installs a housing substantially flush with the wall or ceiling, and the housing accepts the grille for attachment to the housing. With some current wood designs, there is no mechanism or design feature to prevent the housing frame from being either "pushed" beyond the plane of the wall surface or "pulled" tight with the wall surface. When using hardware that hinges, catches or locks the two components of the assembly, it is important to install the framed housing even or "flush" with the wall surface for the mechanism to connect accurately and as designed. This could cause the frame to extend from the wall, or worse, inadvertently fall out. This problem can occur with both new construction and renovations.

A related issue with existing HVAC systems and return air grille assemblies is the ease of the grille's removal for access to the filter or duct space and yet provide a secure attachment to the framed housing. This access is accomplished with either a single-piece removable grille alone or with a two-part return air grille assembly. For the single-piece removable grille that does not use a housing, the return air grille has movable hardware fasteners that (i) holds the filter to the grille and (ii) affixes directly into the opening, which requires alterations to accommodate the thickness of the grille frame and movable hardware. This type of grille uses retaining clips to snap into a rough opening without the housing, where screws must be precisely positioned on the wall framing, so these screws catch the retaining clips.

For the two-part removable assembly, there are obstacles that current designs pose in addition to practical installation challenges. Current designs of both wood and metal grilles commonly have an exposed grille frame that is larger than the return air opening to conceal the rough edges of the return air opening in the wall. However, the size of an exposed grille frame that extends beyond the housing, such as a wood grille frame, is generally too large to hinge to the smaller housing and still allow the grille sufficient space to rotate away from the housing without hitting the structure. A larger, specialty hinge would obstruct a filter's installation or removal, so that would not be an option. This size difference helps explain why current wood grille designs require the grille to be inserted straight in without angling. Such grille assemblies typically utilizes movable hardware fasteners, such as a separable snap lock or "bullet catch," retaining clip, or the like. The grille assembly hardware must align with other hardware, such as a separable snap lock receiving end, screw, or the like, that are attached to the framed-housing component or rough opening in the wall in such a way that all the hardware fits or aligns properly to work together. Further, there is the potential cost of additional time and effort on the part of the homeowner or contractor to re-install the hardware if it is not installed properly.

A second installation challenge stems from the lack of flexibility that current designs offer if an installation error occurs. With the current design, the hardware must align precisely. Sometimes problems occur outside the grille or grille assembly itself, such as a wall framing for the return air opening being built out-of-level or out-of-square, or with the grille and/or its frame being misaligned, possibly causing the compatible hardware components to misalign and not work properly.

The third installation challenge is mitigating the potential for accidents once the grille is installed, especially when the design does not include a safety latch. Even when installed and all pieces are working properly, grilles without latches are designed to "pull out" from the return air opening or framed housing. A child holding onto the grille for support or bumping the grille could cause the grille to dislodge and fall, causing injury to the child. The potential for this problem is exacerbated by any warping or bending of the removable/retractable grille or its framed housing.

Therefore, there remains a need for an air grille assembly that can be made of thicker materials and still fit within a standardized opening, such as from a prior metal air grille assembly installation, while allowing a standardized filter to fit within the present assembly. There also remains a need for an improved securing and detachment system for the grille that minimizes manufacturing and installation costs.

SUMMARY

The present disclosure provides an air grille assembly for use especially with air conditioning and heating ducts, having a detachable grille constructed of a relatively thick material, such as wood, synthetic wood, vinyl or the like. The grille generally has an exterior frame that can conceal the border of the structure opening and mount against the structure and can be coupled to a housing with a thinner material (including stamped metal or plastic) that in at least one embodiment can fit in a standard-sized opening, and leave enough room for a standard-sized filter commensurate with such opening. Further, the disclosure can also provide a return air grille assembly having a detachable grille that allows for an exposed exterior frame with no movable or visible hardware fasteners, and can be removed from a housing by lifting the grille frame straight up (when in a vertical position, as in a wall) or over (when in a horizontal position, as in a ceiling), angling out the bottom and then sliding down. The grille assembly can be coupled into a structure's opening, and can include flanges to help ensure proper mounting without the use of special tools.

The disclosure provides an air grille assembly, comprising (a) an air grille housing adapted to be installed into a structure, the structure establishing a first face and an opening formed at least partially therethrough and the structure opening having a perimeter, the air grille housing comprising a material forming an outer perimeter of the housing and establishing a housing opening sized smaller than the opening perimeter of the structure and adapted to be at least partially inserted therethrough a first flange coupled to at least a portion of the housing outer perimeter and sized larger than the opening perimeter to restrict insertion through the opening; a second flange coupled to at least a portion of the housing distal from the first flange, the second flange sized smaller than the opening perimeter to allow insertion therethrough; a first ridge coupled to the housing outer perimeter and extending inward a first length from the housing outer perimeter toward a center portion of the housing opening; and a second ridge coupled to the housing outer perimeter is a direction opposite from the first ridge in the housing opening and extending inward a second length from the housing outer perimeter toward the center portion of the housing opening, the second length being shorter than the first length; and (b) an air grille adapted to be at least partially inserted into the air grille housing, comprising (1) a frame, comprising (i) an insert portion having an outer perimeter sized smaller than the housing opening and adapted to be inserted at least partially therethrough, the insert portion sized to have an insert portion clearance between the insert portion outer perimeter and an adjacent portion of the housing when the frame is coupled with the housing, the insert portion comprising a first groove formed in a first surface of the insert portion outer perimeter and having a first depth relative to the first surface, the first groove adapted to engage the first ridge coupled to the housing, the first depth establishing a first groove clearance between the first groove and the first ridge of the housing when the frame is coupled with the housing; and a second groove formed in a second surface distal from the first surface of the insert portion outer perimeter and having a second depth relative to the second surface, the second groove adapted to engage the second ridge coupled to the housing, the second depth establishing a latching dimension for the frame to the housing when coupled with the housing and sized smaller than the insert portion clearance and the first groove clearance; and (ii) a frame portion coupled to the insert portion and having an outer perimeter sized larger than the housing opening; and (2) at least one louver coupled to the frame and adapted to allow air flow between the louver and the frame through the housing opening.

The disclosure provides a process for coupling an air grille assembly together, comprising positioning the air grille adjacent an air grille housing, the air grille housing having an outer perimeter establishing an opening and a first ridge and a second ridge, distal from the first ridge, each ridge being disposed in a direction toward the center of the housing opening, and the air grille having an interior portion with an outer perimeter sized to be inserted into the housing opening and a frame portion with an outer perimeter larger than the housing opening; aligning a first groove, formed in the interior portion of the air grille, with the first ridge of the housing; aligning a second groove, formed in the interior portion of the air grille distal from the first groove, with the second ridge of the housing; tilting the interior portion of the air grille having the first groove toward the housing and moving the air grille across the plane of the housing opening in the direction of the first ridge; engaging the first groove with the first ridge sufficiently to allow the grille interior portion adjacent the second groove to clear the second ridge of the housing; maintaining some engagement between the first groove and the first ridge, while tilting the interior portion of the air grille having the second groove toward the housing and moving the air grille across the plane of the housing opening in the direction of the second ridge; and engaging the second groove with the second ridge.

The disclosure provides an air grille assembly for renovating an existing air grille assembly in an opening of a structure, comprising an air grille housing made of a material having a thickness, the housing being adapted to be inserted into the structure opening after removal of a previously installed air grille housing from the structure opening, the housing having an opening sized to support a filter of at least the same nominal size as supported by the previously installed air grille housing; and an air grille made of a material having a thickness greater than the housing thickness, the air grille comprising a grille frame and an interior portion smaller than the air grille housing, the interior portion being adapted to be at least partially inserted into the air grille housing to support the at least same nominal size filter from the previously installed air grille housing between the air grille and the housing.

The disclosure also provides an air grille assembly for inserting into an opening of a structure, the structure opening having a nominal size, comprising an air grille housing comprising a housing material having a first thickness and establishing a perimeter around a housing opening of the nominal size of the structure opening and adapted to be inserted into the structure opening, the housing opening further being sized to support a filter of the nominal size of the structure opening; and an air grille having an interior portion smaller than the air grille housing, the interior portion material having a second thickness at least two times thicker than the first thickness to establish an inside cross sectional area smaller than the nominal size, the interior portion adapted to be at least partially inserted into the air grille housing with the nominal size filter coupled between the interior portion of the air grille and a portion of the housing distal from the frame portion of the air grille.

BRIEF DESCRIPTION OF THE DRAWINGS

A more particular description, briefly summarized above, may be had by reference to the embodiments thereof that are illustrated in the appended drawings and described herein. It is to be noted, however, that the appended drawings illustrate only some embodiments of the disclosure and are therefore not to be considered limiting of its scope, because other equally effective embodiments can apply.

DETAILED DESCRIPTION OF A PREFERRED EMBODIMENT

Figure 16:
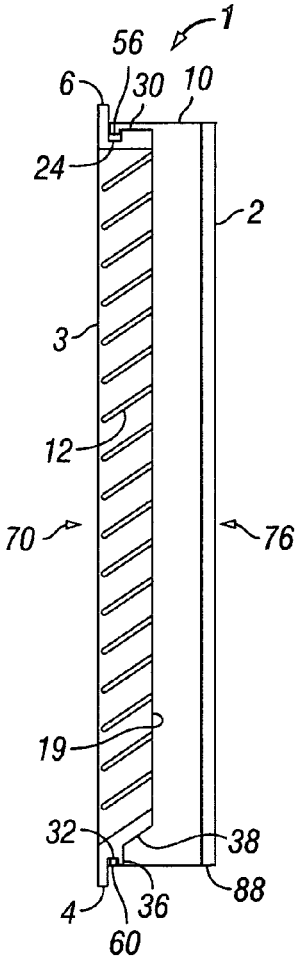
FIG. 16 is a schematic cross-sectional view of the air grille assembly in an engaged condition.

Referring briefly to FIG. 16 for the assembly for an overall depiction, FIG. 16 is a schematic cross-sectional view of the air grille assembly in an installed condition. The air grille assembly 1 is generally for a return portion of an HVAC system in a structure, such as a residence or building, although it can be used for other applications. The return air grille assembly 1 includes a housing 2 and a grille 3. The housing 2 and the grille 3 may each be made of individual components to be described in more detail below. However, it is to be understood that the number of components and sub-assemblies can vary in accordance with particular manufacturing processes as would be known to those with ordinary skill in the art given the description of the present invention contained herein. Thus, the figures are illustrative only and represent at lease one embodiment of the present invention and of the assembly thereof, as limited only by the claims. For the convenience of the reader, the term "front" and like terms are generally referencing an orientation toward an outside of a structure opening in the direction of the front 70 on FIG. 16 where for example the grille frame would be visible, and the term "rear" and like terms are generally referencing an orientation toward the inside of the structure opening in the direction of the rear 76, where for example filtered air would generally have passed through the housing. Various elements in the various series are labeled with the same numbers and the description of each is incorporated in the various figures.

Figure 1:
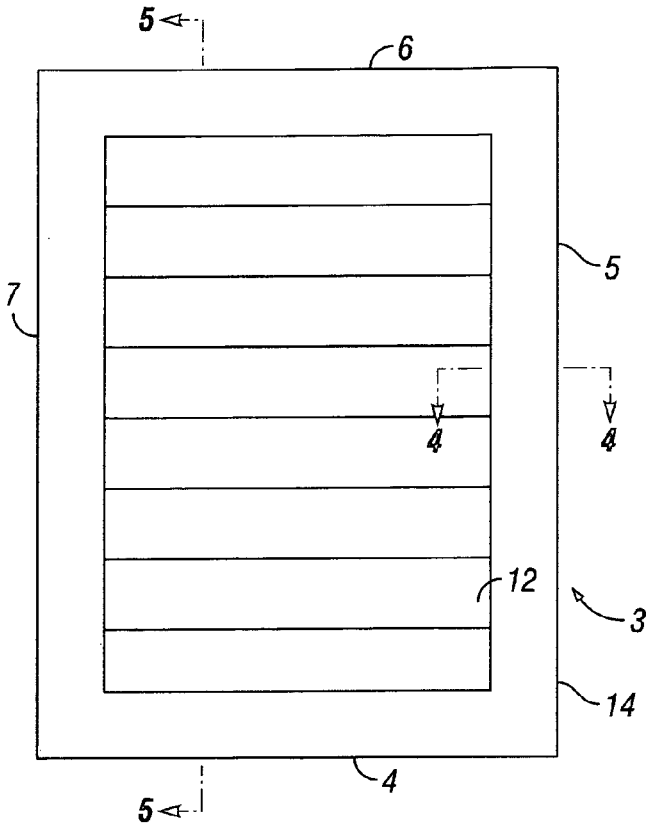
FIG. 1 is a schematic view of one embodiment of a grille for the air grille assembly.

FIG. 1 is a schematic view of one embodiment of a grille for the air grille assembly. The grille 3 generally includes one or more louvers 12 coupled with a grille frame 14. The term "coupled," "coupling," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include integrally forming one functional member with another. The grille frame 14 generally includes a bottom 4, a first side 5, a top 6, and a second side 7, which represent the outer extent of the grille frame.

The louvers and/or the grille frame can be made of wood, wood look-alike material, plastic or other structural materials. Generally, the louvers and/or grille frame will be made of material that is at least twice as thick as the typical stamped metal grille and frame, often at least five times as thick, and sometimes at least ten times as thick. In many instances, the standard, stamped metal grille and frame are made from material of about 0.030 inches thick. In at least one embodiment, the thickness of the grille frame 14 ranges from about 0.38 inches to about 0.75 inches, for example, on the sides, top, and/or bottom, although other thicknesses are possible. Because of the unique interface between the grille 3, the housing 2 and a filter, the thickness of the grille 3 can vary widely and can be limited by the airflow through the louvers 12 and by aesthetic considerations.

Figure 2:
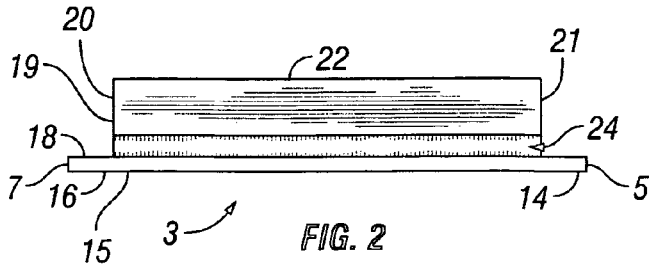
FIG. 2 is a schematic top view of the grille of FIG. 1.
Figure 3:
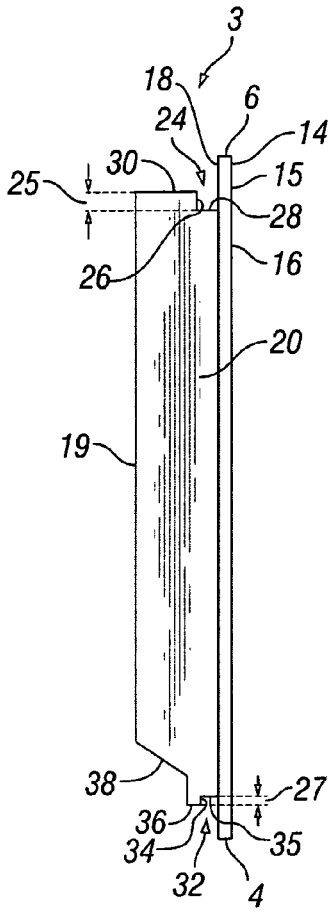
FIG. 3 is a schematic side view of the grille of FIG. 1.

FIG. 2 is a schematic top view of the grille of FIG. 1. FIG. 3 is a schematic side view of the grille at FIG. 1. FIGS. 2 and 3 will be described in conjunction with each other. The grille 3 includes the grille frame 14. The grille frame 14 generally includes an external frame portion 15 and an insert portion 19 coupled thereto. The external frame portion 15 generally represents the portion of the grille that extends beyond the face 46 of a structure 42, shown in FIG. 11, when the grille 3 is installed in the housing 2. The insert portion 19 represents the grille portion that can be inserted into an opening of the housing and is generally smaller than the external frame portion.

The external frame portion 15 of the grille is generally formed by the front face 16 facing outward from the structure and a rear face 18 to establish a thickness, and bounded by the bottom 4, side 5, top 6, and side 7. It is to be understood that the shape of the grille 3 and/or housing 2 can vary to any geometric shape as may be desired or practical. Generally, it is common to have a rectangular or square grille, and thus, without limitation, the exemplary embodiments are drawn in like manner. The external frame portion 15 of the grille frame 14 generally extends beyond one or more boundaries, that is, at least a portion, of the outer perimeter of the insert portion 19 as a type of "flange" to the insert portion. Aesthetically, the external frame portion 15 can extend laterally beyond most if not all of the of the insert portion 19 perimeter, as shown in FIG. 2 and FIG. 3, and even the housing perimeter, so that the housing is concealed from view by the grille after assembling to the housing.

Uniquely, the present disclosure includes an insert portion 19 that is sized to fit within a standard opening created by the housing 2, unlike prior efforts using thicker materials. Thus, the same size filter as would normally be included in an air grille assembly for the particular size of opening in the structure, such as in an existing air grille assembly installation, can be used with the present air grille assembly. The insert portion 19 generally includes a first side 20 and a second side 21, shown in FIG. 2, and a top 30, and a bottom 36, shown in FIG. 3, to establish a perimeter. The depth of the insert portion 19 is generally bounded by the external frame portion 15 in a frontal direction and a rear face 22 in a rearward direction, distal from the frame portion 15.

In at least one embodiment, the insert portion 19 can include one or more grooves 24, 32. The first groove 24 can be formed in the top 30 of the insert portion 19 and a second groove 32 can be formed in the bottom of the insert portion 19. The grooves, and variations such as shown in FIG. 5*a*, can form a system to allow the grille frame 14 to be removed from the housing 2, independent of supplemental or moveable hardware. One illustration of such movement is described herein relative to FIGS. 16–19. This unique interface between the grille frame 14 and the housing 2 differs from prior art that depends upon additional fasteners and other hardware.

The grooves 24, 32 and the insert portion 19 are generally of smaller dimensions than the external frame portion 15, so that the grooves and insert portion can fit into the housing opening without allowing the external frame portion to fit in the opening. Thus, the grooves are formed in the grille rearward of the larger external frame portion 15 to be able to properly orient the grille 3.

The first groove 24 in at least one embodiment can be formed between the external frame portion 15, a bottom surface 28 of the groove 24, and a rearward surface 26 of the groove 24. In at least one embodiment, the groove extends from the first side 20 to the second side 21, although it is to be understood that the length and location can vary as well as the groove 24 can include multiple segmented sections, as desired. The groove 24 has a depth 25 that is sized to accommodate a ridge or curl of the housing, described in more detail below. Further, the depth of the groove 24 is generally coordinated with the relative depth of the second groove 32. In at least one embodiment, the depth of the groove 24 is deeper than the depth of the groove 32, so that the grille assembly can advantageously use gravity when the housing 2 is installed at an inclined position to assist in securing the grille with a housing, as explained below.

The second groove 32 is likewise formed, in at least one embodiment, between the external frame portion 15, a bottom surface 35 of the groove 32, and a rearward surface 34 of the groove 32. The groove 32 has a depth 27. Similar to groove 24, the location and length of the groove 32 can vary. For example, the groove 32 can extend from side to side of the insert portion 19, partially across the insert portion 19, or in segmented portions.

Further, the insert portion 19 generally includes a relief surface 38. The relief surface 38 can be angled or otherwise formed to provide clearance to allow for positioning and angling of the grille 3 during installation and removal from the housing 2. The relief surface 38 can include one or more segmented surfaces, such as shown in FIG. 3.

Figure 4:
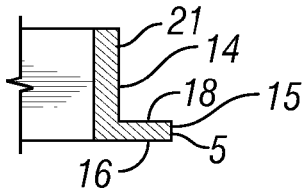
FIG. 4 is a schematic cross-sectional view through a side of the grille shown in FIG. 1.

FIG. 4 is a schematic cross-sectional view through a side of the grille shown in FIG. 1. In at least one embodiment, the grille frame 14 can be formed from members having an angular cross-section assembled to form the grille frame 14. For example, the angular members could include the combined formation of the external frame portion 15, described above, with the insert portion 19 of the grille frame. Alternatively, the grille frame 14 can include the assembly of one or more members to form the grille frame embodiment illustrated in FIG. 4. Further, the shape of the cross-section can vary as may be appropriate to the particular installation and application, and, thus, is only exemplary.

Figure 5:
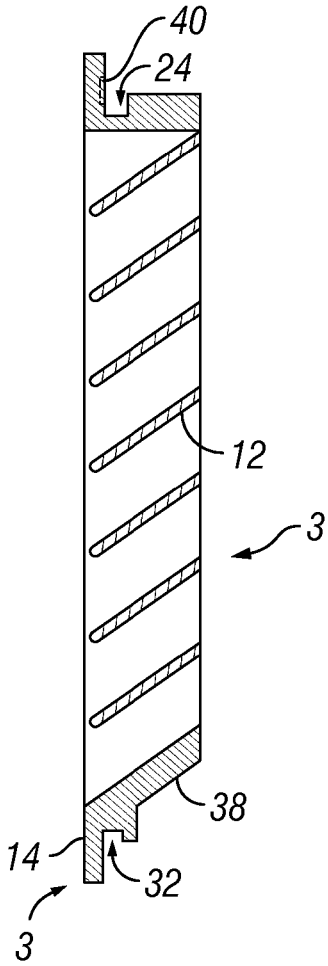
FIG. 5 is a schematic cross-sectional view through louvers of the grille shown in FIG. 1.
Figure 5A:
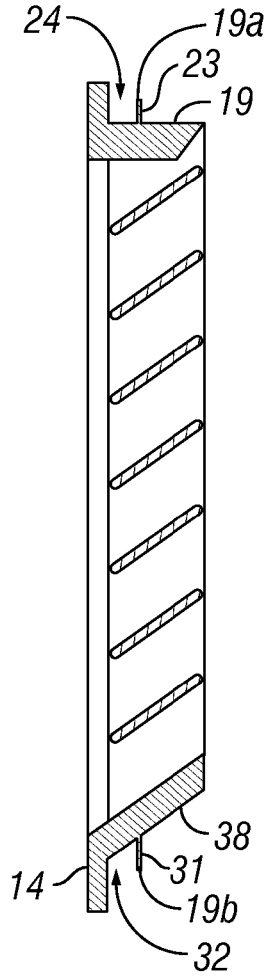
FIG. 5*a* is a cross section schematic view of another embodiment of the grille frame and the insert portion.

FIG. 5 is a schematic cross-sectional view through the louvers of the grille shown in FIG. 1. The grille frame 14 can be coupled with one or more louvers 12. In general, one or more louvers 12 will be spaced at a distance from each other depending on a variety of conditions. Without limitation, some spacing considerations include airflow, aesthetic concealment of the filter (not shown) behind the grille 3, child safety, and other considerations, as would be known to those with ordinary skill in the art. In at least one embodiment, the grille frame 14 can include one or more magnets 40. The one or more magnets may be used to help retain the grille in close proximity to a magnetic material on the housing 2. While the magnets in general do not form the primary coupling of the grille 3 with the housing 2, the magnet 40 may assist in reducing vibration or other relative movement between the grille and housing. The grooves 24, 32 described herein are also illustrated.

Figure 8:
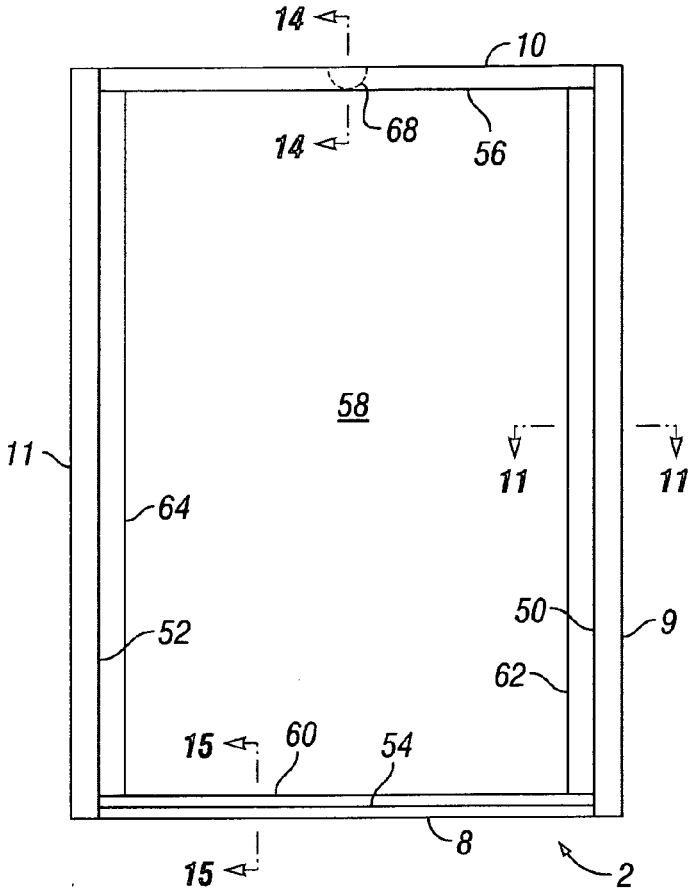
FIG. 8 is a schematic front view of a housing of the air grille assembly.

FIG. 5*a* is a cross sectional schematic view of another embodiment of the grille frame 14 and the insert portion 19. Because of manufacturing efficiencies, grooves 24, 32 can be formed in alternative manners. For example, a protrusion 23, such as a L-shaped clip, can be coupled to the insert portion 19 to form an effective groove 24, as has been described herein. The upper surface of the protrusion 23 effectively forms an extension 19*a* of the insert portion 19. Similarly, a protrusion 31 can be coupled to the insert portion 19 to form an effective groove 32, as has been described herein. The lower surface of the protrusion 31 effectively forms an extension 19*b* of the insert portion 19. In general, the opening 58 shown in FIG. 8 is sized to allow the insert portion 19 including the extension surfaces 19*a*, 19*b* therethrough.

Further, one or more of the protrusions 23, 31 can be adjustable to vary the size of the groove. The protrusions can be adjusted and then secured to the insert portion during manufacturing, during an installation of the air grille assembly to the structure, or at other appropriate times.

Figure 6:
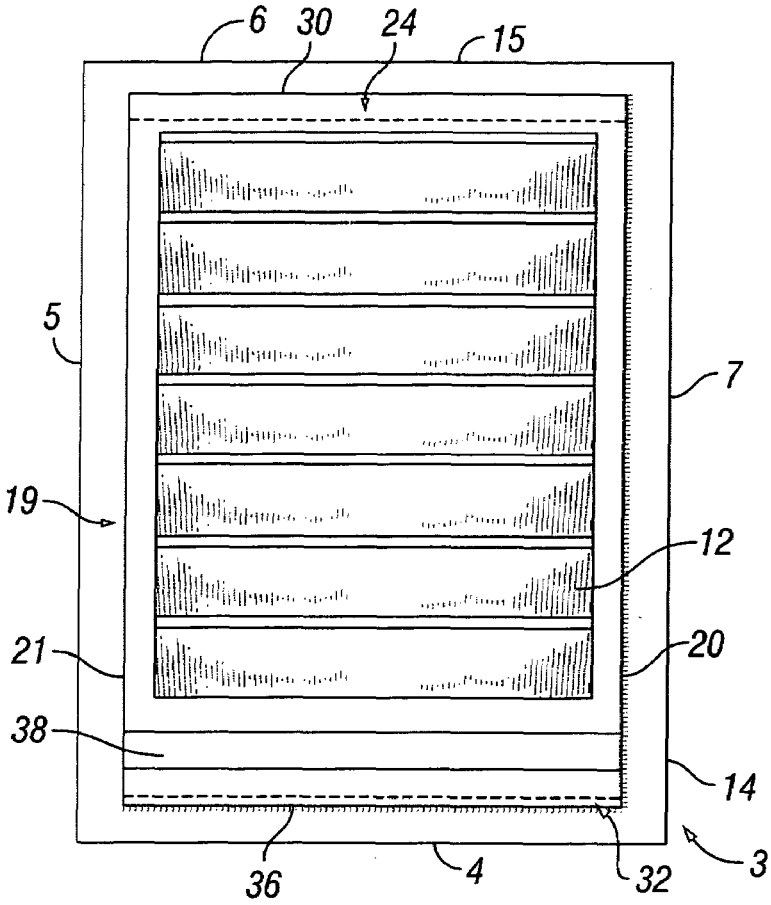
FIG. 6 is a rear schematic view of the grille shown in FIG. 1.

FIG. 6 is a rear schematic view of the grille shown in FIG. 1. The rear view of the grille 3 illustrates relative placement of the insert portion 19 with the grille frame 14. In at least one embodiment, the external frame portion 15 can extend around one or more perimeter surfaces of the insert portion 19 to form a flange. Again, because of the uniqueness of the present invention and its design, the thickness of the material used to form the insert portion 19 can vary widely as may be appropriate to the particular circumstances and yet allow the air grille assembly to use a standard size filter that would be appropriate for the structure opening through which a standard prior art housing could accommodate.

The position of the grooves 24 and 32 have been described in reference to the top and bottom surfaces of the insert portion 19. It is to be understood that the orientation of the grooves in the figures is shown advantageously to operate with gravity. Such an orientation is generally used with most installations. However, if other installations are made, the grooves may advantageously be varied from the particular location shown herein and such is contemplated by the present invention. For example, if the air grille assembly was located in a horizontal surface, instead of generally vertical, the grooves 24, 32 could be placed in a similar location, or on other locations, such as the sides 20, 21. Further, the actual orientation of the grooves 24, 32 could be rotated by, for example, 90 degrees to take advantage of gravity effects on a horizontal air grille assembly 1 to achieve a similar relative motion as described in reference to FIGS. 16–19, below. Further, the location of the grooves along the top 30, and the bottom 36 of the insert portion 19 can vary. While the grooves 24, 32 are shown in general adjacent to the rear face 18, it is to be expressly understood that the grooves could be located at a distance away from the rear face 18 with appropriate adjustments made in the housing 2, if desired.

Figure 7:
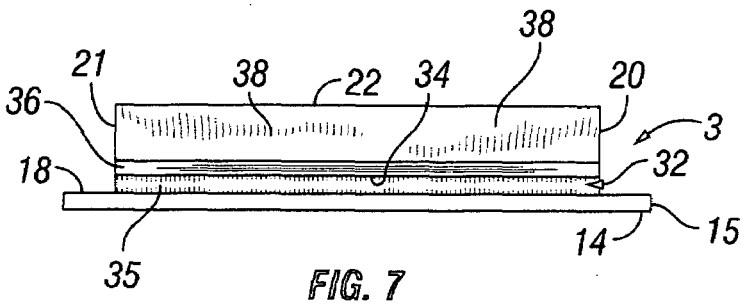
FIG. 7 is a schematic bottom view of the grille shown in FIG. 6.

FIG. 7 is a schematic bottom view of the grille shown in FIG. 6. The groove 32 can be formed in the insert portion 19 behind the rear face 18. In general, the groove 32 is bounded by a bottom surface 35, an outer surface 34, and in at least one embodiment, the rear face 18 of the external frame portion 15. Further, the depth of the groove 32 can be determined by the relative distance between the bottom surface 35 and the bottom 36 of the insert portion 19.

FIG. 8 is a schematic front view of a housing of the air grille assembly. The housing 2 can be formed as an integral piece or by the coupling of multiple members. In the embodiment shown, the sides, top, and bottom vary from each other and thus, it may be expedient in manufacturing to form separate members and then couple them together, although the invention is not limited to such manufacturing processes.

Figure 11:
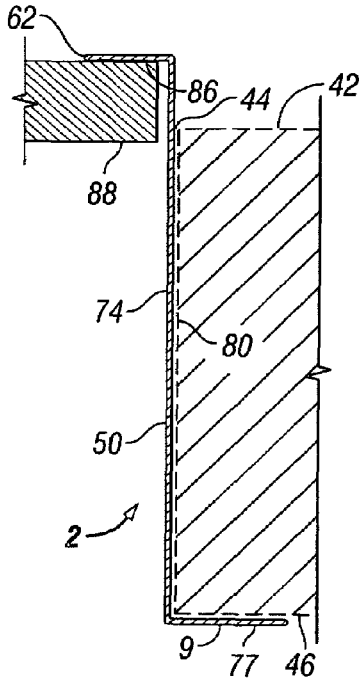
FIG. 11 is a schematic cross-sectional view through a side of the housing of FIG. 8.

In general, the housing 2 is used to support a filter (shown in FIG. 11) and the insert portion 19 (shown in FIG. 2) of the grille frame 14. The external surfaces of the housing are adapted to be inserted into the structure opening and the internal surfaces form an opening 58 through which the filter and the insert portion 19 are disposed. The housing material is relatively thin in at least one embodiment compared to the grille, particularly the interior portion of the grille. Thus, for the purposes of the present disclosure, the internal surfaces and external surfaces of the housing are collectively termed "outer perimeter." As stated earlier, the size and configuration can vary as may be appropriate for a particular desired shape. Further, the relative thin housing material allows for some bending or other movement during installation to a structure opening that is out of shape by some margin. A rectangular or square shape is generally used in the industry, and thus is shown for exemplary purposes only. The outer dimensions of the housing 2 that are inserted into a structure opening are bounded by a bottom 8, a top 10, and sides 80, 81, shown in FIG. 9. In at least one embodiment, the housing can include flanges 9, 11 to assist in maintaining the housing in frontal alignment with a face on the structure opening, as shown in FIG. 11.

Figure 9:
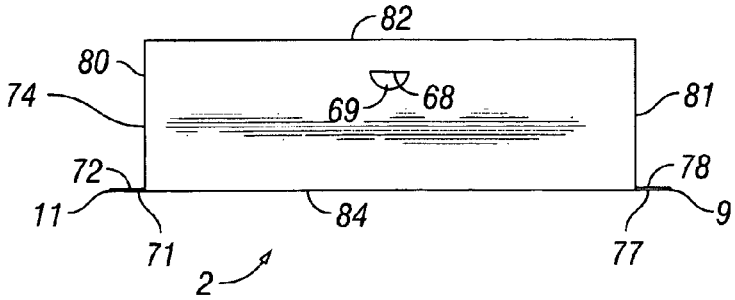
FIG. 9 is a schematic top view of the housing of FIG. 8.

FIG. 9 is a schematic top view of the housing of FIG. 8. The housing 2 can include an insert portion 74 as the main body of the housing that is generally dimensioned to be inserted into the structure opening 44, shown in FIG. 11. The insert portion 74 generally includes a first side 80, a second side 81, and a rear face 82, and a top and bottom shown in FIG. 8. The insert portion 74 can be provided in a variety of shapes and sizes to accommodate a variety of openings. Generally, the insert portion 74 is sized to allow a standard-sized filter that corresponds to the opening (not shown). Advantageously and in contrast to current wooden grille frames systems, the present invention can use a standard size filter that would normally fit in a standard size opening of a typical housing designed for the particular sized structure opening, and yet uniquely allows a much thicker grille as described herein.

One or more flanges 9, 11 extend outwardly from the insert portion 74. The flanges 9, 11 can restrict the insert portion 74 from being located deeper into the wall opening. While the flanges 9, 11 are shown outwardly from the sides 80, 81, it is to be understood that the flanges can be placed at other locations in or around the housing 2. For example, the flanges could be located a certain distance from the front face 84 or rear face 78 to allow the insert portion 74 to extend outward or inward from the surface of the wall opening. Also, the flanges could be placed on the top and/or bottom. Further, the flanges can extend the entire length of the structure or in one or more segmented portions.

Generally, the flange will include a front face and a rear face. For example, the flange 11 includes a front face 71 and a rear face 72. Likewise, the flange 9 can include a front face 77 and a rear face 78. In general, the front faces 71, 77 can contact the grille 3 and specifically may contact the rear face 18 of the grille frame 14. Further, the rear faces 72, 78 can be used to contact the structure surface, such as the wall surface, shown in FIG. 11, of the opening to which the insert portion 74 is installed.

In at least one embodiment, a restriction 68 can be coupled to the top 10. As will be described in reference to FIG. 14, the restriction 68 can be used to restrict the movement of a filter installed in the housing 2. For example and without limitation, a restriction 68 can be formed by severing a portion of the top 10 and folding it downward, leaving a punch out area 69. However, the restriction can be formed from any number of items formed, fastened, or otherwise coupled to a portion of the housing 2.

Figure 10:
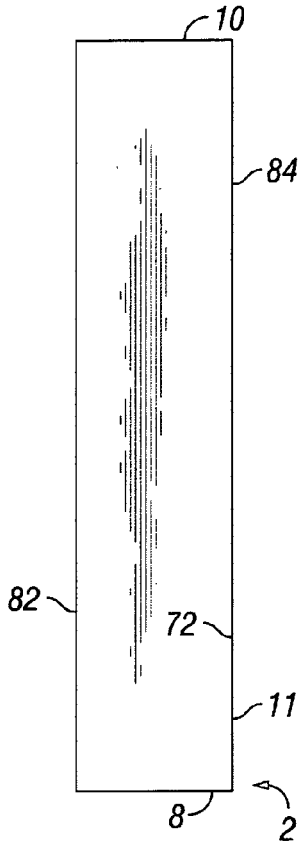
FIG. 10 is a schematic side view of the housing of FIG. 8.

FIG. 10 is a schematic side view of the housing of FIG. 8. In general, the housing includes a front face 84, a rear face 82, a top 10, and a bottom 8 from this perspective. Further, one or more flanges, such as flange 11, also shown in FIGS. 8 and 9, can be used to assist in the installation of the housing 2 into a structure opening. The shape, depth, and other features can be varied according to the size and shape of the opening, the size and shape of the filter to be used, the depth of the opening, the depth of the grille in conjunction with the filter, and other factors as would be known to those with ordinary skill in the art given the disclosure contained herein.

FIG. 11 is a schematic cross-sectional view through a side of the housing of FIG. 8. The housing 2 is shown installed into an opening 44 of a structure 42. While the opening for the housing can be formed in a wall, the disclosure is not limited to walls. The air grille assembly and particularly the housing can be suitable for coupling to a variety of structures, such as a wall, ceiling, frame of a larger housing, or other structural member(s).

The housing 2 is generally formed a relatively thin sheet of material, such as steel, aluminum, structural plastic, or other suitable material to hold the grille 3, shown in FIG. 1. In at least one embodiment, the housing 2 includes a first side 80 of an insert portion 74. The insert portion 74 can be coupled to a flange 9 having a front face 77 and a rear face 78. The front face 77 can be disposed adjacent the rear face 18 of the grille 3, shown in FIG. 2, while the rear face 78 can be disposed adjacent a surface of a structure into which the housing 2 is mounted.

A rearward portion of the first side 80 can include a rear flange 62. The rear flange 62 can extend inward from the inside surface 50 of the first side 80 to form a supporting surface for a filter 88 disposed in the housing 2. The filter 88 can abut a front face 86 of the rear flange 62.

In general, the dimension of the housing 2, from the inside surface 50 of the side 80 to its corresponding inside surface 52 of an opposite side 81, shown in FIGS. 8 and 9, can correspond to standard dimensions as would be appropriate for a prior art housing in the same sized opening. The arrangement of the grille, housing, and filter are such that a standard-sized filter for a given opening can be used and yet allow a thicker grille to be inserted therein in the space bounded by the inside surfaces 50, 52, bottom ridge 60, and top ridge 56. Thus, the present disclosure in at least one embodiment can readily be used to renovate an existing installation of a grille housing to be used the grille frame of the present disclosure without sacrificing air flow through a smaller size filter and without necessitating enlarging the structure opening sometimes at considerable expense.

The length of the flange 62 toward the opening formed within the insert portion 74 is generally of sufficient length to support the filter 88 without unduly restricting airflow therethrough. While the dimensions can vary considerably, in at least one embodiment, the length of the flange toward the opening can be in the range of 0.2 inches to 1.0 inch as exemplary dimensions only.

Figure 12:
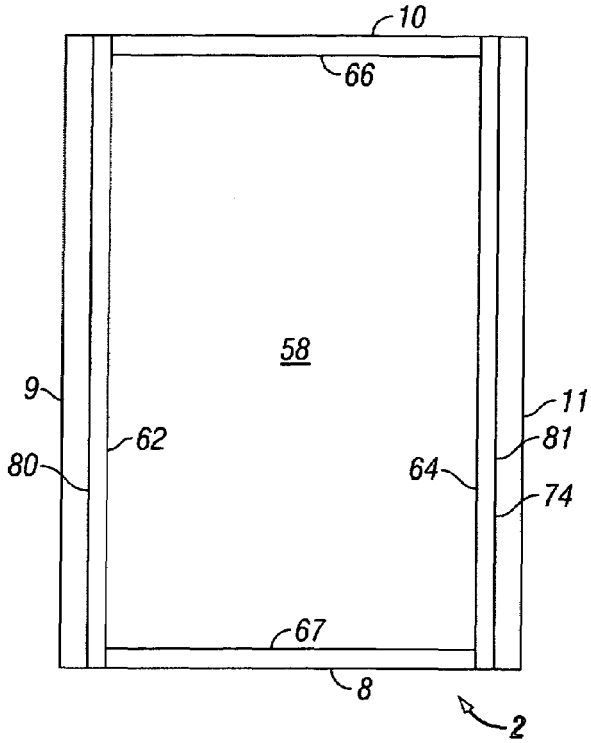
FIG. 12 is a rear schematic view of the housing of FIG. 8.

FIG. 12 is a rear schematic view of the housing of FIG. 8. The housing 2 includes an insert portion 74 having a first side 80 and a second side 81. Further, the housing 2 can include a first flange 11 and a second flange 9, shown in FIG. 8. The rear view of the housing 2 also illustrates rear flanges 62, 64, 66, 67 around the rear perimeter of the housing 2. The rear flanges provide surfaces to retain a filter 88, shown in FIG. 11. In some embodiments, the rear flanges also provide at least a partial sealing surface for the filter so that airflow through opening 58 is directed through the filter 88.

Figure 13:
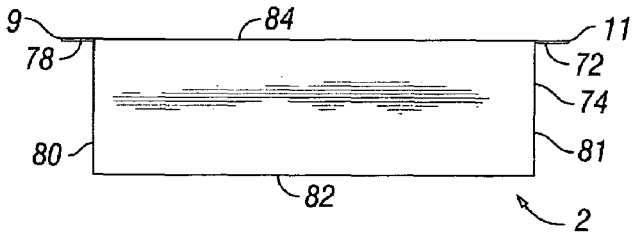
FIG. 13 is a bottom schematic view of the housing of FIG. 12.

FIG. 13 is a bottom schematic view of the housing of FIG. 12. Similar to FIG. 9, the housing 2 can include an insert portion 74, a front face 84, a rear face 82, and sides 80, 81. Further, the housing 2 can include one or more flanges, such as flanges 9, 11. Each flange can have a rear face 78, 72, respectively.

Figure 14:
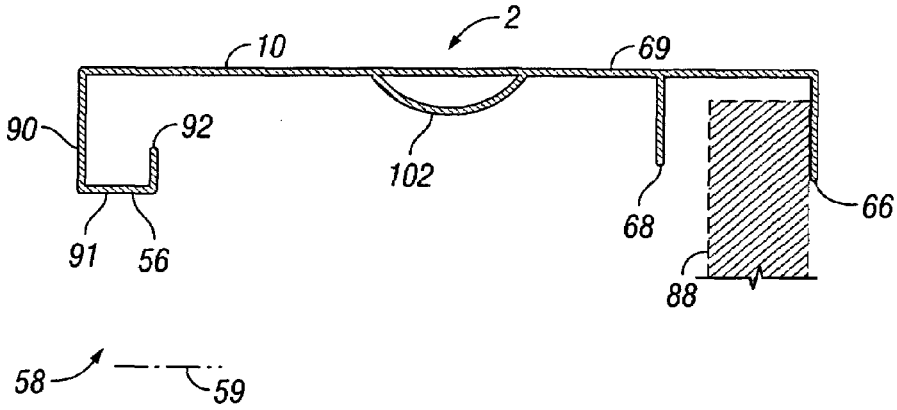
FIG. 14 is a cross-sectional schematic view through a top of the housing in FIG. 8.

FIG. 14 is a cross-sectional schematic view through a top of the housing in FIG. 8. In at least one embodiment, a restriction 68 can be formed in the top 10 to help restrict movement of a filter 88 when installed between the restriction 68 and the top rear flange 66. The restrictor can be placed in other locations and the embodiment is only exemplary.

The housing 2 can also include a bias element 102 coupled to members of the housing, such as the top 10. The bias element 102, such as a leaf spring, can bias the insert portion 19 of the frame 14 away from the top ridge 56 and toward the bottom ridge 60 shown in FIG. 15. The bias element can be advantageous when the housing is installed for example in horizontal installations and gravity is less effective on pulling the insert portion downward toward the bottom ridge 60.

The top 10 can include a top ridge 56 that generally extends toward a center portion 59 of the opening 58. In at least one embodiment, and without limitation, the top ridge 56 can be formed from the same or similar materials as the top 10 as a "curl" of the material. For example, the top 10 can include a portion that can be bent or otherwise formed into the ridge 56 having a front face 90 of the top ridge, a bottom 91, and a flange 92. The flange 92 can extend back to the top 10 or be disposed away from the top 10, as shown, depending on the manufacturing technique and particular requirements of the application. Further, the ridge 56 can be formed from other materials, hollow or solid, and can be coupled to the top 10 or other portion of the housing 2, as appropriate. In at least one embodiment, the front face 90 of the top ridge can be aligned in the same plane as the front face 84, shown in FIGS. 9 and 10. In other embodiments, the top ridge 56 could be formed at different distances from the plane of the front face 84 as may be suitable for the particular depth at which the grille 3 is to be placed into the housing 2. Without limitation, generally, the location of the top ridge 56 relative to the front face 90 of the top ridge 56 and the front face 84 of the housing 2 will correspond to the location of the first groove 24 in the top 6 of the grille 3, shown in FIGS. 2 and 3.

In general, the length of the top ridge 56 extending into the opening 58 of the housing 2 is generally less than the corresponding depth of the groove 24 formed in the grille 3. As explained herein, the difference in depths allows the groove 24 and ridge 56 to be aligned and still allows upward movement of the grille 3, given sufficient clearance between the insert portion 19, shown in FIG. 3, and the housing top 10 to allow such movement. The upward movement allows the bottom 36 of the insert portion 19 to be lifted over the bottom ridge 60 to align the second groove 32 with the bottom ridge 60.

Figure 15:
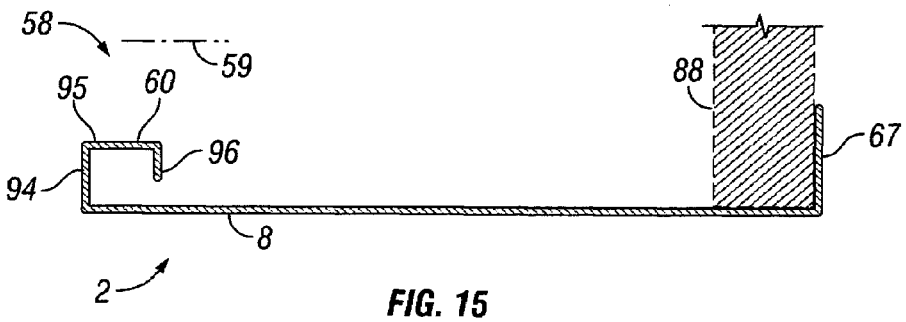
FIG. 15 is a schematic cross-sectional view through a bottom of the housing shown in FIG. 8.

FIG. 15 is a schematic cross-sectional view through a bottom of the housing shown in FIG. 8. A bottom rear flange 67 is coupled to the bottom 8. The bottom flange assists in supporting the filter 88.

The housing 2 can also include a bottom ridge 60. In at least one embodiment, the bottom ridge 60 can be formed with the same or similar material as the bottom 8 by bending or otherwise forming the various portions of the bottom ridge 60. For example, a front face 94 can be formed that extends inward toward the opening 58, a top 95 can be formed on the bottom ridge, and a flange 96 formed adjacent to the top 95. Alternatively, the bottom ridge 60 can be formed with other hollow or solid materials that can be fastened, connected, or otherwise coupled to the bottom 8.

The bottom ridge 60 extends into the opening 58 toward a center portion 59. The depth of the bottom ridge 60 can be less, the same, or greater than the depth of the groove 32 formed in the grille 3, shown in FIG. 3. In at least one embodiment, the grille is positioned by gravity in a lowered state over the bottom ridge 60. If the groove 32 is shallower than the top ridge 60, then the bottom surface 35, shown in FIG. 3, of the groove 32 will generally be engaged with the top 95 of the bottom ridge 60. If the depth of the groove 32 is greater than the height of the bottom ridge 60, then the bottom 36 of the insert portion 19, shown in FIG. 3, will generally engage the bottom 8 and restricts further downward movement.

In either case, using gravity, the forward movement of the bottom of the grille away from the housing 2 is positively restricted by the interaction between the groove 32 and the bottom ridge 60. Further, when the groove 32 is engaged with the bottom ridge 60, the dimensions of the grille 3 and the first groove 24 at the top of the grille generally allow the groove 24 to stay engaged with the top ridge 56. Thus, the grille is substantially locked in place between the ridges 56, 60, shown in FIGS. 14 and 15, of the housing 2 in conjunction with the grooves 24, 32 of the grille 3, shown in FIG. 3.

Figure 17:
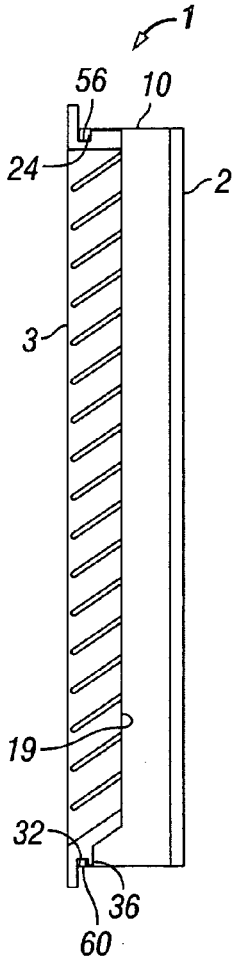
FIG. 17 is a schematic cross-sectional view of the air grille assembly in a partially disengaged position.
Figure 18:
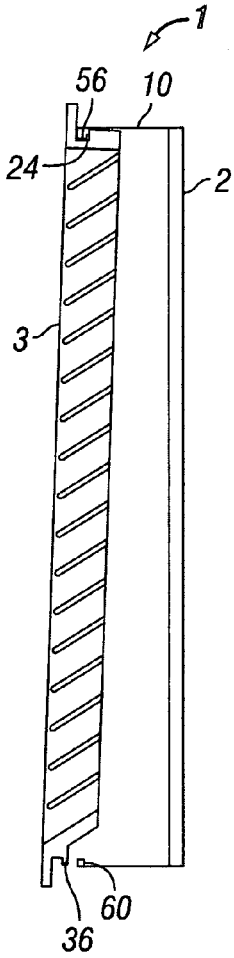
FIG. 18 is a schematic cross-sectional view of the air grille assembly with the grille bottom disengaged from the housing.
Figure 19:
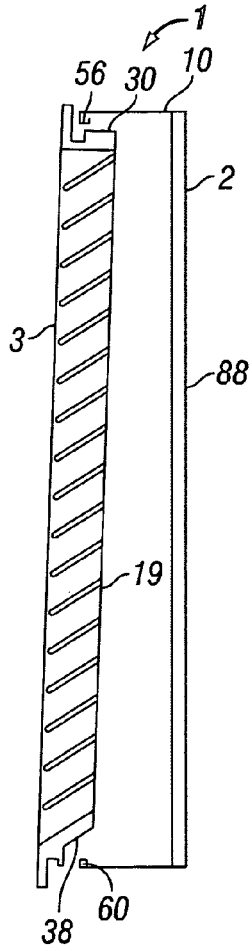
FIG. 19 is a schematic cross-sectional view of the air grille assembly with the grille disengaged from the housing.
Figure 20:
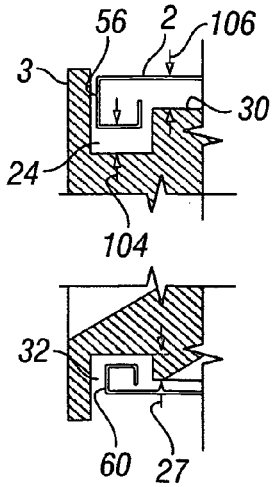
FIG. 20 is a schematic cross-sectional enlarged view of portions of the air grille assembly shown in FIG. 16.

FIG. 16 is a schematic cross-sectional view of the air grille assembly in an engaged condition. FIG. 17 is a schematic cross-sectional view of the air grille assembly in a partially disengaged position. FIG. 18 is a schematic cross-sectional view of the air grille assembly with the grille bottom disengaged from the housing. FIG. 19 is a schematic cross-sectional view of the air grille assembly with the grille disengaged from the housing. FIG. 20 is a schematic cross-sectional enlarged view of portions of the air grille assembly shown in FIG. 16. The figures will be described in conjunction with each other.

In FIG. 16, the grille 3 is engaged with the housing 2. In at least one embodiment, the grille is engaged with both the top ridge 56 and the bottom ridge 60. The filter 88 is in position and illustrates one operating condition for the air grille assembly in which airflow generally passes through the grille 3 with the louvers 12, through the filter 88, and then into a duct or other air chamber (not shown) to the rear of the filter.

In this embodiment, the grille 3 is resting through gravity on the bottom ridge 60 of the housing 2 with the corresponding grove 32 of the grille 3. The bottom 36 of the insert portion 19 is rearward of the bottom ridge 60. The bottom 4 of the grille 3 is frontward of the ridge 60. Thus, the bottom of the grille 3 is restricted in movement from the engagement between the grille and the housing. Similarly, the top ridge 56 of the housing 2 is aligned with the groove 24. The top 30 of the insert portion 19 is rearward of the top ridge 56. The top 6 of the grille 3 is frontward of the top ridge 56. Thus, the top of the grille 3 is also restricted in movement. A child, or even an adult, would generally be unable to pull the grille 3 directly outward, and thus the design can reduce injury or other mishap.

Referencing FIG. 20, generally, there is a first groove clearance 104 between the top ridge 56 and the first groove 24. There is also an insert portion clearance 106 between the top 30 of the insert portion 19 and the top 10 of the housing 2. The second groove 32 relative to a lower surface of the insert portion 19 establishes a depth 27. The clearances in conjunction with the groove depth allow upward movement to couple or release the grille from the housing, as described herein. In general, the depth 27 is smaller than either of the insert portion clearance and the first groove clearance, so that the clearances allow the insert portion to be lifted sufficiently to allow the inert portion lower surface to clear the bottom ridge 60. Thus, the groove depth 27 can establish a securing depth for the lower portion of the grille frame.

As shown in FIG. 17, to disengage the grille 3 from the housing 2, in at least one embodiment, the grille 3 can be lifted until, for example, upward movement is restricted by either the top 30 engaging the top 10 of the housing 2 or the groove 24 engaging the top ridge 56. Dimensionally, there is sufficient clearance 104 between the top ridge 56 and the groove 24 and sufficient clearance 106 between the top 10 and the insert portion 19 relative to the groove depth 27 of groove 32, such that when the grille 3 is raised in an upward position, the bottom 36 or other lower surfaces of the insert portion 19 can clear the bottom ridge 60. Such clearance can allow the bottom 36 or other lower surfaces to be moved frontward and over the bottom ridge 60, thus releasing the bottom of the grille from the housing 2.

As shown in FIG. 18, the grille 3 can be angled outward at the bottom 36 while the top of the grille 3 is still engaged with the housing 2. The lower portion of the grille is thus cleared of the housing and the bottom ridge 60.

As shown in FIG. 19, the grille can be lowered by taking advantage of the clearance between the bottom ridge 60 and the relief surface 38. The lowering movement also releases the top of the grille 3 from the top ridge 56. When the grille 3 is lowered sufficiently so that the top 30 of the insert portion 19 is below the top ridge 56, then the top of the grille 3 can be moved frontward, releasing the entire grille from the housing 2.

The filter 88 can be accessed for exchange or other maintenance with the grille 3 removed from the housing 2. To install the grille with the housing, a reverse procedure can be followed.

EXAMPLE 1

A standard-sized opening can be formed in a structural wall or ceiling for an HVAC system having a nominal size of 20"×25". The structure opening can be actually dimensioned about 20¼" by 25¼" (generally from 20⅛" to 20½"×25⅛" to 25½"). An air grille housing of the present disclosure, such as made of stamped metal, can be inserted into the structure opening until the flanges of the housing are adjacent the face of the structure opening and secured thereto. In stark contrast to other wooden grilles (or similar material having a thickness several times the thickness of standard grilles) in combination with a housing, the air grille housing of the present disclosure defines a housing opening sized for a filter of the same nominal dimension of 20"×25".

Other designs either enlarge the structural opening and therefore the opening is no longer the same nominal dimension with the standard sizing, or reduce the nominal size of the effective opening, such as for a filter, to a smaller size to avoid tearing out the opening, such as a 18"×20" nominal size instead of the original 20"×25" nominal size. Other designs discard the use of a housing altogether. The present disclosure can be used with a much thicker grille but retain the nominal dimension of a filter being the same as the nominal size of the structure opening. The filter can be inserted into the housing toward a rearward position of the housing. An air grille frame, having an interior portion sized to be inserted in the housing opening, can then be secured to the housing as described herein.

While a variety of sized openings and dimensions for the air grille assembly can be used, it is believed that standard-sized openings will generally be used due to the convenience of obtaining commercially available replacement filters. However, the underlying concepts are limited only by the claims.

While exemplary embodiments of securing the grille 3 with the housing 2 have been described herein, it is to be understood that the invention is not limited to such embodiments. For example, bias elements, discussed herein, could be used to bias the grille in one direction or another, which might operate independent of any gravitational forces. Such a bias could for example, be especially useful in horizontal installations where gravity could apply equally to the "top" and "bottom" surfaces of the grille and housing. Further, in at least one embodiment, the invention has been described independent of hardware. In some embodiments, especially those installed in which gravity may not be particularly useful as in horizontal installations, such hardware can be used to help insure that the grille has not inadvertently released and falls out. Further, the design of at least one embodiment allows flexibility on installation by reducing the need for critical alignment of various hardware pieces to ensure securing the grille to the housing. Still further, various types of "grooves" can be formed either into the insert portion material or as an extension of the insert portion in keeping with the disclosure and claims.

Various basics of the invention have been explained herein. The various techniques and devices disclosed represent a portion of that which those skilled in the art would readily understand from the teachings of this application. Details for the implementation thereof can be added by those with ordinary skill in the art given the disclosure contained herein. The accompanying figures may contain additional information not specifically discussed in the text and such information is included as part of the disclosure herein. Additionally, various combinations and permutations of all elements or applications can be created and presented. All can be done to optimize performance in a specific application.

The various steps described herein can be combined with other steps, can occur in a variety of sequences unless otherwise specifically limited, various steps can be interlineated with the stated steps, and the stated steps can be split into multiple steps. Unless the context requires otherwise, the word "comprise" or variations such as "comprises" or "comprising", should be understood to imply the inclusion of at least the stated element or step or group of elements or steps or equivalents thereof, and not the exclusion of any other element or step or group of elements or steps or equivalents thereof.

Further, any documents to which reference is made in the application for this patent as well as all references listed in any list of references filed with the application are hereby incorporated by reference. However, to the extent statements might be considered inconsistent with the patenting of this invention such statements are expressly not to be considered as made by the applicant(s).

Also, any diretions such as "top," "bottom," "left," "right," "upper," "lower," and other directions and orientations are described herein for clarity in reference to the figures and are not to be limiting of the actual device or system or use of the device or system. The device or system may be used in a number of directions and orientations.

The invention claimed is:

1. An air grille assembly, comprising:

a. an air grille housing adapted to be installed into a structure, the structure establishing a first face and an opening formed at least partially therethrough and the structure opening having a perimeter, the air grille housing comprising:

i. a material forming an outer perimeter of the housing and establishing a housing opening sized smaller than the opening perimeter of the structure and adapted to be at least partially inserted therethrough;

ii. a first flange coupled to at least a portion of the housing outer perimeter and sized larger than the opening perimeter to restrict insertion through the opening;

iii. a second flange coupled to at least a portion of the housing distal from the first flange, the second flange sized smaller than the opening perimeter to allow insertion therethrough;

iv. a first ridge coupled to the housing outer perimeter and extending inward a first length from the housing outer perimeter toward a center portion of the housing opening; and v. a second ridge coupled to the housing outer perimeter in a direction opposite from the first ridge in the housing opening and extending inward a second length from the housing outer perimeter toward the center portion of the housing opening, the second length being shorter than the first length;

b. an air grille adapted to be at least partially inserted into the air grille housing, comprising:

i. a frame, comprising:

a) an insert portion having an outer perimeter sized smaller than the housing opening and adapted to be inserted at least partially therethrough, the insert portion sized to have an insert portion clearance between the insert portion outer perimeter and an adjacent portion of the housing when the frame is coupled with the housing, the insert portion comprising:

i) a first groove formed in a first surface of the insert portion outer perimeter and having a first depth relative to the first surface, the first groove adapted to engage the first ridge coupled to the housing, the first depth establishing a first groove clearance between the first groove and the first ridge of the housing when the frame is coupled with the housing; and ii) a second groove formed in a second surface distal from the first surface of the insert portion outer perimeter and having a second depth relative to the second surface, the second groove adapted to engage the second ridge coupled to the housing, the second depth establishing a latching dimension for the frame to the housing when coupled with the housing and sized smaller than the insert portion clearance and the first groove clearance; and b) a frame portion coupled to the insert portion and having an outer perimeter sized larger than the housing opening; and ii. at least one louver coupled to the frame and adapted to allow air flow between the louver and the frame through the housing opening.

2. The air grille assembly of claim 1, further comprising a filter engaging surface disposed on the insert portion distal from the frame portion.

3. The air grille assembly of claim 1, wherein the grooves are disposed on the insert portion adjacent the frame portion.

4. The air grille assembly of claim 1, wherein the housing is adapted to replace an previously installed air grille housing having a predetermined opening and continue to a same size filter as used by the previously installed air grille housing.

5. The air grille assembly of claim 1, wherein at least one of the flanges is disposed adjacent the first face of the structure and substantially coplanar therewith.

6. The air grille assembly of claim 1, wherein the frame portion is sized larger than the first flange of the housing and adapted to conceal the flange when the frame portion is mounted to the housing.

7. The air grille assembly of claim 1, wherein the housing is inclined and the second ridge is lower in elevation that the first ridge so that the interior portion having the second groove at least partially rests by gravity on the housing.

* * * * *

UNITED STATES PATENT AND TRADEMARK OFFICE

CERTIFICATE OF CORRECTION

PATENT NO. : 7,258,607 B1
APPLICATION NO. : 11/029760
DATED : August 21, 2007
INVENTOR(S) : Steven C. Machiorlette et al.

It is certified that error appears in the above-identified patent and that said Letters Patent is hereby corrected as shown below:

Delete the following phrase contained in the last two lines of claim 1(a)(v) at col. 16, II. 63-64, namely, delete the words:

“,the second length being shorter than the first length”

Signed and Sealed this

Eighteenth Day of December, 2007

JON W. DUDAS
*Director of the United States Patent and Trademark Office*